US005961239A

United States Patent [19]

Nishioka et al.

[11] Patent Number: 5,961,239

[45] Date of Patent: Oct. 5, 1999

[54] BARREL CYLINDER FOR WRITING INSTRUMENT

[75] Inventors: Yuji Nishioka; Takeshi Kobayashi, both of Yokohama, Japan

[73] Assignee: Mitsubishi Pencil Kabushiki Kaisha, Tokyo, Japan

[21] Appl. No.: 09/020,131

[22] Filed: Feb. 6, 1998

[30] Foreign Application Priority Data

Feb. 26, 1997 [JP] Japan ..... 9-058445
Feb. 26, 1997 [JP] Japan ..... 9-058446

[51] Int. Cl.[6] ..... B43K 7/00

[52] U.S. Cl. ..... 401/209; 401/208; 401/216

[58] Field of Search ..... 401/209, 216, 401/109, 110, 112, 176, 199, 127, 208–217, 30–33, 99, 115

[56] References Cited

U.S. PATENT DOCUMENTS 501,895 7/1893 Moore ..... 401/99
926,611 6/1909 De La Rue ..... 401/176
2,369,224 2/1945 Ferger ..... 401/99
2,996,749 8/1961 Hester ..... 401/99
3,966,336 6/1976 Lotfallah ..... 401/209

FOREIGN PATENT DOCUMENTS 500818 4/1952 France ..... 401/209

*Primary Examiner*—Henry J. Recla
*Assistant Examiner*—Tuan Nguyen
*Attorney, Agent, or Firm*—Darby & Darby

[57] ABSTRACT

In a barrel cylinder for a writing instrument, a writing element support hole portion or support projection is formed in a deep portion of a distal end port of the barrel cylinder where a writing element extends, the writing element support hole portion or support projection having an inner diameter slightly larger than the outer diameter of the writing element, and an enlarged port portion having an inner diameter larger than the writing element support hole portion or support projection and a gate mark appearing at a location of an inner surface thereof is formed at an inlet port portion of the distal end port of the barrel cylinder which is on the outer side of the writing element support hole portion or support projection.

6 Claims, 9 Drawing Sheets

BARREL CYLINDER FOR WRITING INSTRUMENT

BACKGROUND OF THE INVENTION (1) Field of the Invention

The present invention relates to a barrel cylinder for a plastic writing instrument which has, at its distal end, a distal end port of the barrel cylinder where a writing element extends, and which is injection-molded.

(2) Description of the Prior Art

When a barrel cylinder for a writing instrument is injection-molded with a plastic, the mark of the gate of the mold, i.e., a gate mark, appears on the product. If the gate mark appears on the surface of the product, the appearance of the product becomes poor to degrade the quality of the article. Therefore, generally, the mold is designed such that the gate mark appears at a location of the product where the gate mark is not noticeable. In the case of a barrel cylinder for a writing instrument, for example, an inner surface portion of the distal end port of the barrel cylinder where the writing element extends is preferable as the location where the gate mark appears, because the gate mark formed at this location is not easily seen from the outside. However, since the distal end port of the barrel cylinder supports the distal end portion of the writing element so as not to move undesirably and smoothly guides the writing element when the writing element is extended/retracted, the size precision of the distal end port of the barrel cylinder must be increased such that the inner diameter of the distal end port of the barrel cylinder is slightly larger than the outer diameter of the writing element. If a gate mark appears on the inner surface portion of the distal end port of the barrel cylinder, it is difficult to obtain desired size precision.

SUMMARY OF THE INVENTION

It is an object of the present invention to provide a barrel cylinder for a writing instrument wherein a gate mark appears on the inner surface portion of the distal end port of the barrel cylinder such that it is not easily seen, so that the outer appearance becomes good, and a portion of the barrel cylinder that supports or guides the writing element can achieve desired size precision regardless of the gate mark appearing on the inner surface portion of the distal end port of the barrel cylinder.

The present invention has been made in order to achieve the above object, and its gists are as follows.

The first gist of the present invention resides in a barrel cylinder for a writing instrument, characterized in that a writing element support hole portion is formed in a deep portion of a distal end port of the barrel cylinder where a writing element extends, the writing element support hole portion having an inner diameter slightly larger than an outer diameter of the writing element, and an enlarged port portion having an inner diameter larger than that of the writing element support hole portion and a gate mark appearing at a location of an inner surface thereof is formed at an inlet port portion of the distal end port of the barrel cylinder which is on an outer side of the writing element support hole portion.

The second gist of the present invention resides in a barrel cylinder for a writing instrument according to the first gist, characterized in that gate marks appear at a plurality of locations or on an entire circumference of the inner surface of the enlarged port portion.

The third gist of the present invention resides in a barrel cylinder for a writing instrument, characterized in that writing element support projections are formed at a plurality of locations in a circumferential direction of an inner surface at a deep portion of the distal end port of the barrel cylinder where the writing element extends, the writing element support projections having an inscribed diameter slightly larger than an outer diameter of the writing element, and an enlarged port portion having an inner diameter larger than the inscribed diameter of the locations where the writing element support projections are formed and a gate mark appearing at a location of an inner surface thereof is formed at an inlet port portion of the distal end port of the barrel cylinder which is on an outer side of the locations where the writing element support projections are formed.

The fourth gist of the present invention resides in a barrel cylinder for a writing instrument according to the third gist, characterized in that gate marks appear at a plurality of locations or on an entire circumference of the inner surface of the enlarged port portion.

The fifth gist of the present invention resides in a barrel cylinder for a writing instrument according to the third gist, characterized in that writing element support projections are formed at not less than three locations.

The sixth gist of the present invention resides in a barrel cylinder for a writing instrument according to the third gist, characterized in that a surface of each of the writing element support projections forms a curved surface.

DESCRIPTION OF THE PREFERRED EMBODIMENTS

The present invention will be described in detail with reference to the accompanying drawings.

[First Embodiment]

Figure 1:
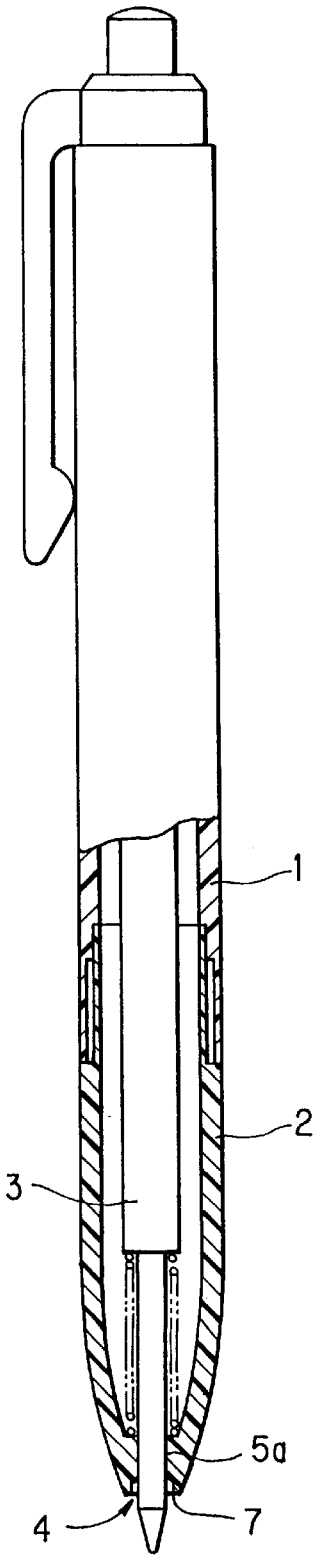
FIG. 1 is a partially cutaway side view showing a state wherein the distal end portion of a writing element is extended from the distal end port of the barrel cylinder.
Figure 2:
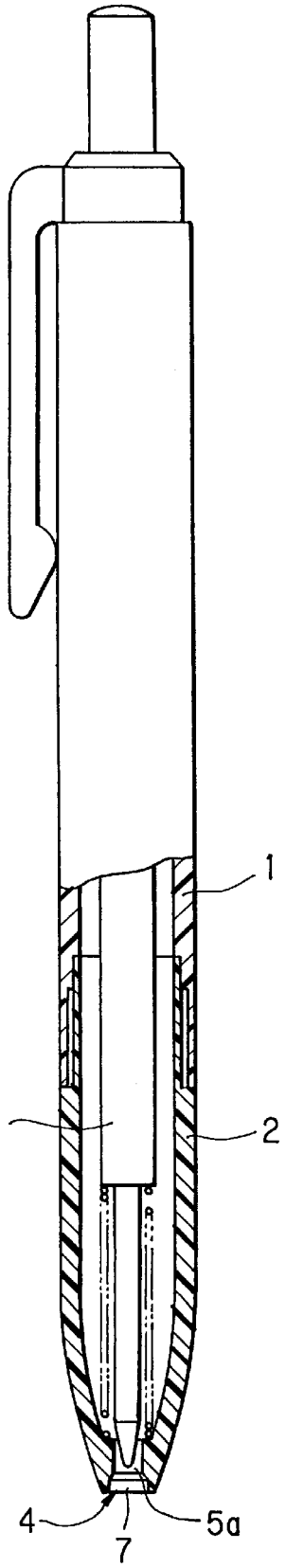
FIG. 2 is a partially cutaway side view showing a state wherein the writing element is retracted in the barrel cylinder.

FIGS. 1 to 4 show a barrel cylinder for a clicking-type ball point pen according to the first embodiment of the present invention. This barrel cylinder is constituted by a rear barrel cylinder 1 and a front barrel cylinder 2 that are connected to each other by screwing. Both the rear barrel cylinder 1 and front barrel cylinder 2 are injection-molded with a plastic by using molds. A writing element 3 is accommodated in the barrel cylinder. As shown in FIGS. 1 and 2, the distal end portion of the writing element 3 can be extended/retracted through a distal end port 4 of the barrel cylinder formed at the distal end of the front barrel cylinder 2.

The inner diameter of the distal end port 4 of the barrel cylinder where the distal end portion of the writing element 3 extends changes at its intermediate portion such that it is large at the inlet port portion and small at the deep portion. More specifically, the deep portion of the distal end port 4 of the barrel cylinder forms a writing element support hole portion 5*a* having an inner diameter slightly larger than the outer diameter of the writing element 3. Note that in this case the outer diameter of the writing element 3 refers to the outer diameter of a portion of the writing element 3 which extends through the writing element support hole portion 5*a*.

Figure 3:
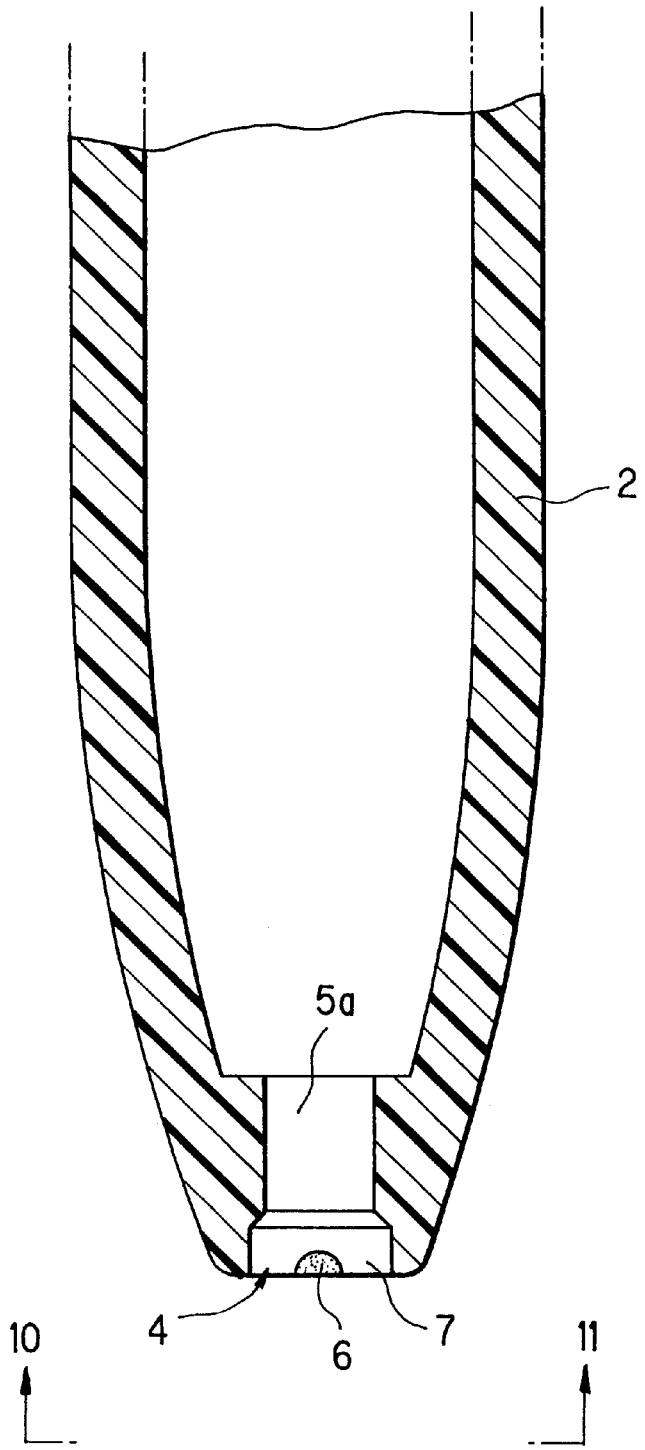
FIG. 3 is an enlarged sectional view of the distal end portion of the barrel cylinder.
Figure 4:
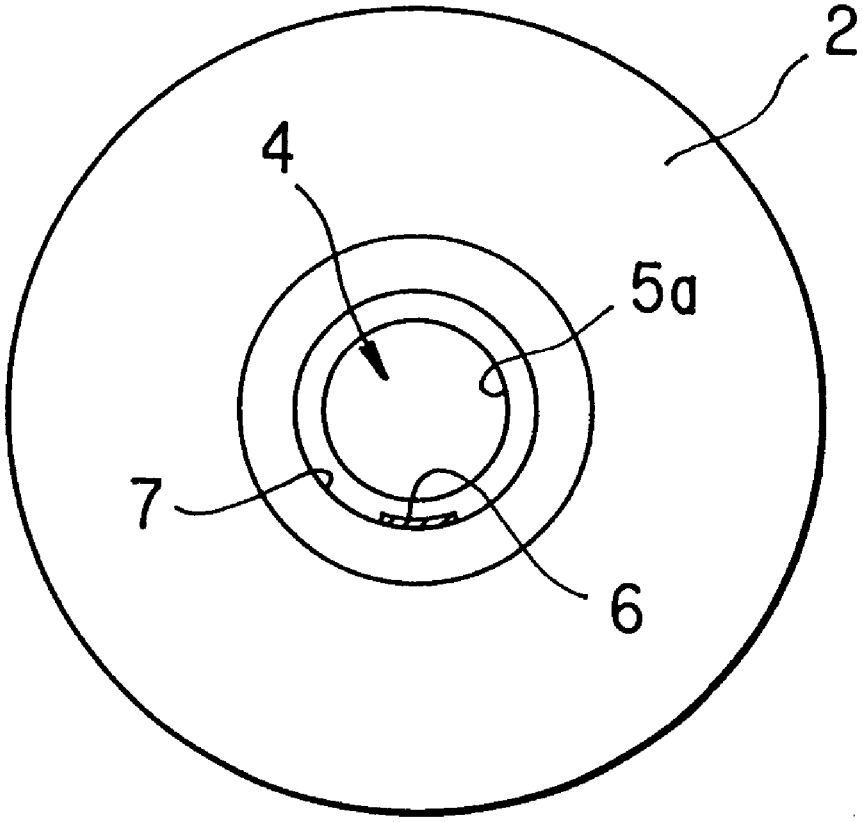
FIG. 4 is a view seen along the line 10-11 of FIG. 3.

The inlet port portion of the distal end port 4 of the barrel cylinder, which is on the outer side of the writing element support hole portion 5*a*, forms an enlarged port portion 7. The inner surface portion of the enlarged port portion 7 opposes the gate of the mold during injection molding, and a mark which is formed when the gate is cut during mold release after molding, i.e., a gate mark 6, appears on this inner surface portion, as shown in FIGS. 3 and 4. The inner diameter of the enlarged port portion 7 is set to be larger than that of the writing element support hole portion 5*a*. More specifically, a step is formed between the inner surface of the enlarged port portion 7 and the inner surface of the writing element support hole portion 5*a*. This step is set to be larger than the projecting height of the gate mark 6 appearing on the inner surface of the enlarged port portion 7. The gate mark 6 may appear at only one location, as shown in FIGS. 3 and 4, or gate marks 6 may appear at a plurality of locations or a gate mark may appear on the entire circumference of the inner surface of the enlarged port portion 7.

Although this embodiment relates to a barrel cylinder for a clicking-type ball point pen, the present invention is not limited to this, and the type of writing instrument is arbitrary.

A barrel cylinder for a writing instrument according to the present invention has the structure as described above. Since the gate mark 6 appears on the inner surface portion of the enlarged port portion 7 of the distal end port 4 of the barrel cylinder, the gate mark 6 is not noticeable so that the outer appearance is improved. Since the distal end port 4 of the barrel cylinder is divided into the writing element support hole portion 5*a* and the enlarged port portion 7, and the gate mark 6 appears at the enlarged port portion 7, the precision of the writing element support hole portion 5*a* is not adversely affected by the gate mark 6 and can be improved easily. Since the inner diameter of the enlarged port portion 7 is set to be larger than that of the writing element support hole portion 5*a* and a step is formed on the inner surface of the enlarged port portion 7, even if the gate mark 6 might appear on the enlarged port portion 7 projects slightly, the projecting amount of the gate mark 6 can be absorbed by the step on the inner surface of the enlarged port portion 7, and the gate mark 6 will not at all adversely affect the writing element 3 supported by the writing element support hole portion 5*a*. Accordingly, in spite that the gate mark 6 appears, the writing element 3 is smoothly supported by the writing element support hole portion 5*a*. When the writing element 3 is extended/retracted, it is guided smoothly, and does not cause an operational error.

Second Embodiment

Figure 5:
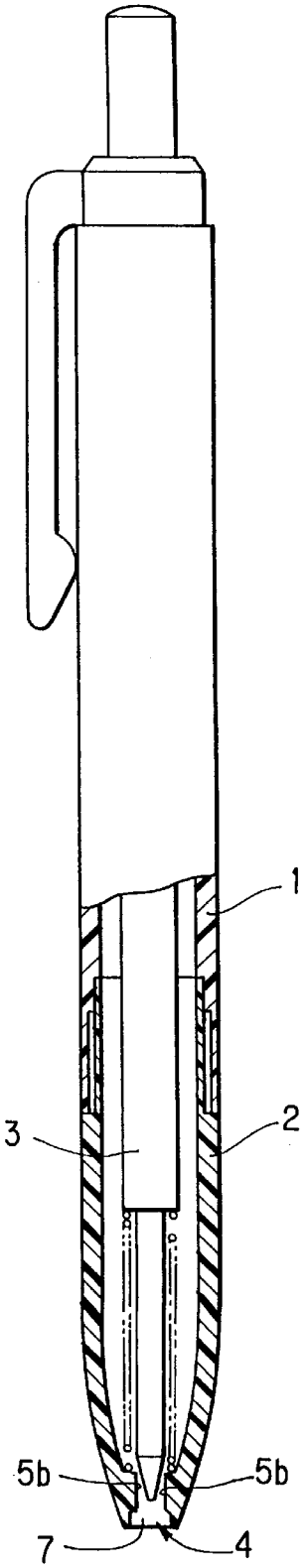
FIG. 5 is a partially cutaway side view showing a state wherein the writing element is retracted in the barrel cylinder.

FIGS. 5 to 10 show a barrel cylinder for a clicking-type ball point pen according to the second embodiment of the present invention. The basic arrangement this barrel cylinder is the same as that of FIG. 1 indicated before and its detailed description thereof will accordingly be omitted. As shown in FIG. 5, writing element support projections 5*b* are formed at four locations in the circumferential portion of the inner surface of the deep portion of a distal end port 4 of the barrel cylinder where the distal end portion of a writing element 3 extends. The inscribed diameter of each of the locations where the writing element support projections 5*b* are formed is slightly larger than the outer diameter of the writing element 3. Note that in this case the outer diameter of the writing element 3 refers to the outer diameter of a portion of the writing element 3 which extends through the locations where the writing element support projections 5*b* are formed.

Figure 6:
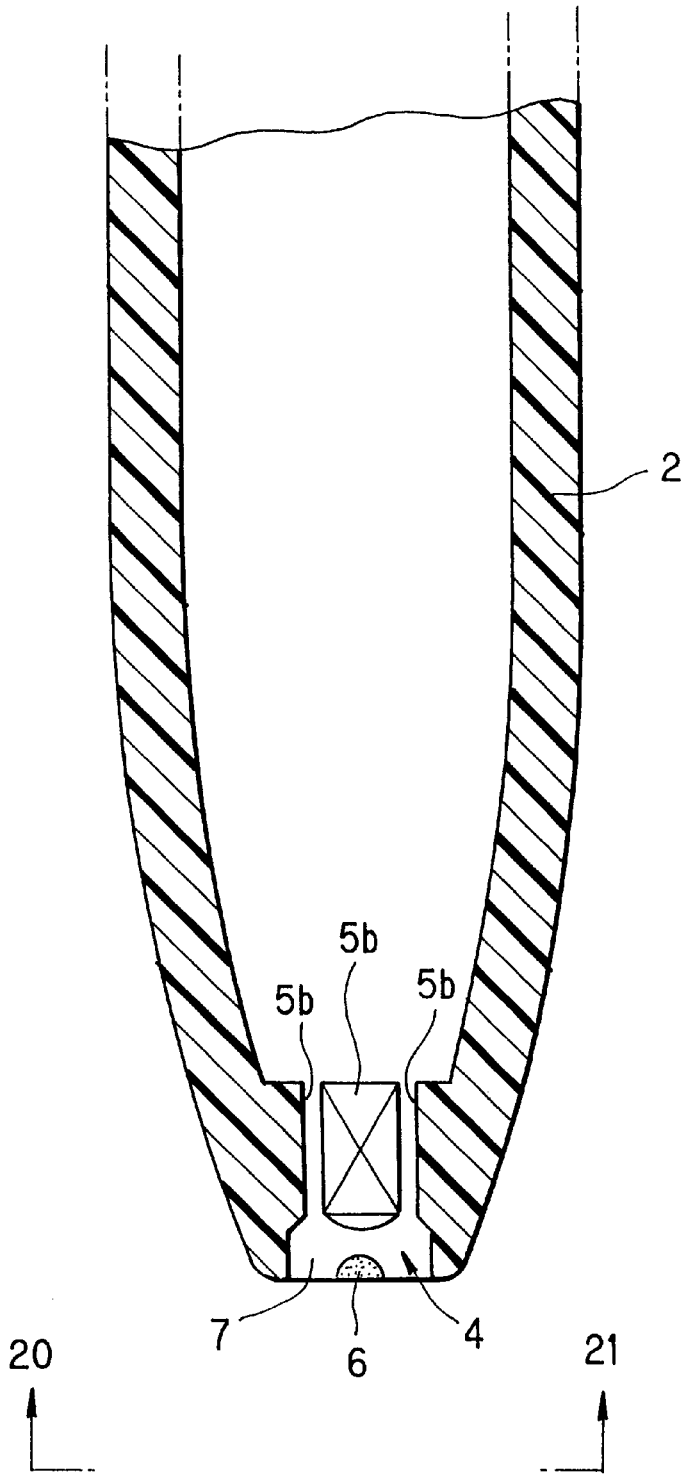
FIG. 6 is an enlarged sectional view of the distal end portion of the barrel cylinder.
Figure 7:
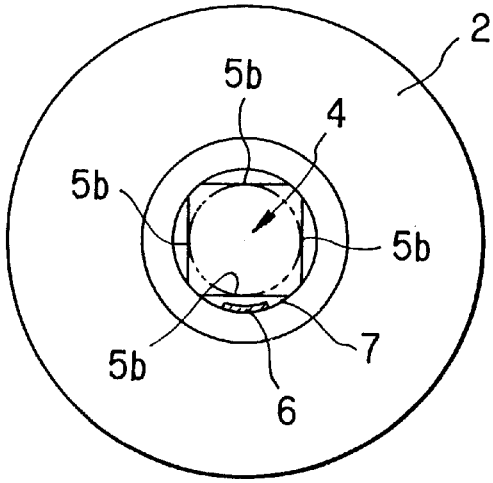
FIG. 7 is a view seen along the line 20-21 of FIG. 6.

The inlet port portion of the distal end port 4 of the barrel cylinder, which is on the outer side of the locations where the writing element support projections 5*b* are formed, forms an enlarged port portion 7. The inner surface portion of the enlarged port portion 7 opposes the gate of the mold during injection molding, and a mark which is formed when the gate is cut during mold release after molding, i.e., a gate mark 6, appears on this inner surface portion, as shown in FIGS. 6 and 7. The inner diameter of the enlarged port portion 7 is set to be larger than the inscribed diameters of the locations where the writing element support projections 5*b* are formed. More specifically, a step is formed between the inner surface of the enlarged port portion 7 and the inner surfaces of the writing element support projections 5*b*. This step is set to be larger than the projecting height of the gate mark 6 appearing on the inner surface of the enlarged port portion 7. The gate mark 6 may appear at only one location, as shown in FIGS. 6 and 7, or gate marks 6 may appear at a plurality of locations or a gate mark 6 may appear on the entire circumference of the inner surface of the enlarged port portion 7.

Figure 8:
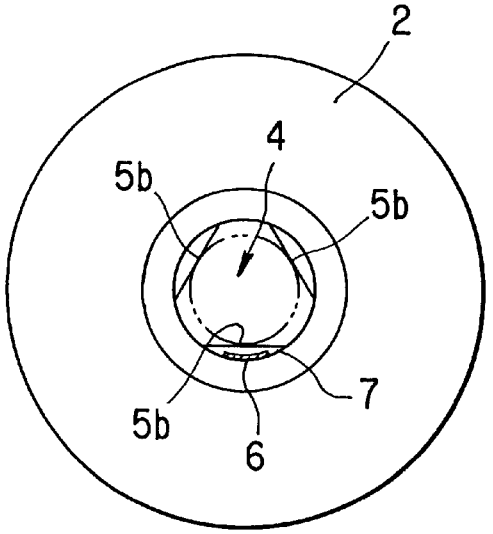
FIG. 8 is an enlarged front view of the distal end port of the barrel cylinder seen from the front.

Although the writing element support projections 5*b* are formed at four locations in this embodiment, they may be formed at three locations, as shown in FIG. 8. The number of writing element support projections 5*b* is arbitrary as far as it is equal to or larger than three.

Figure 9:
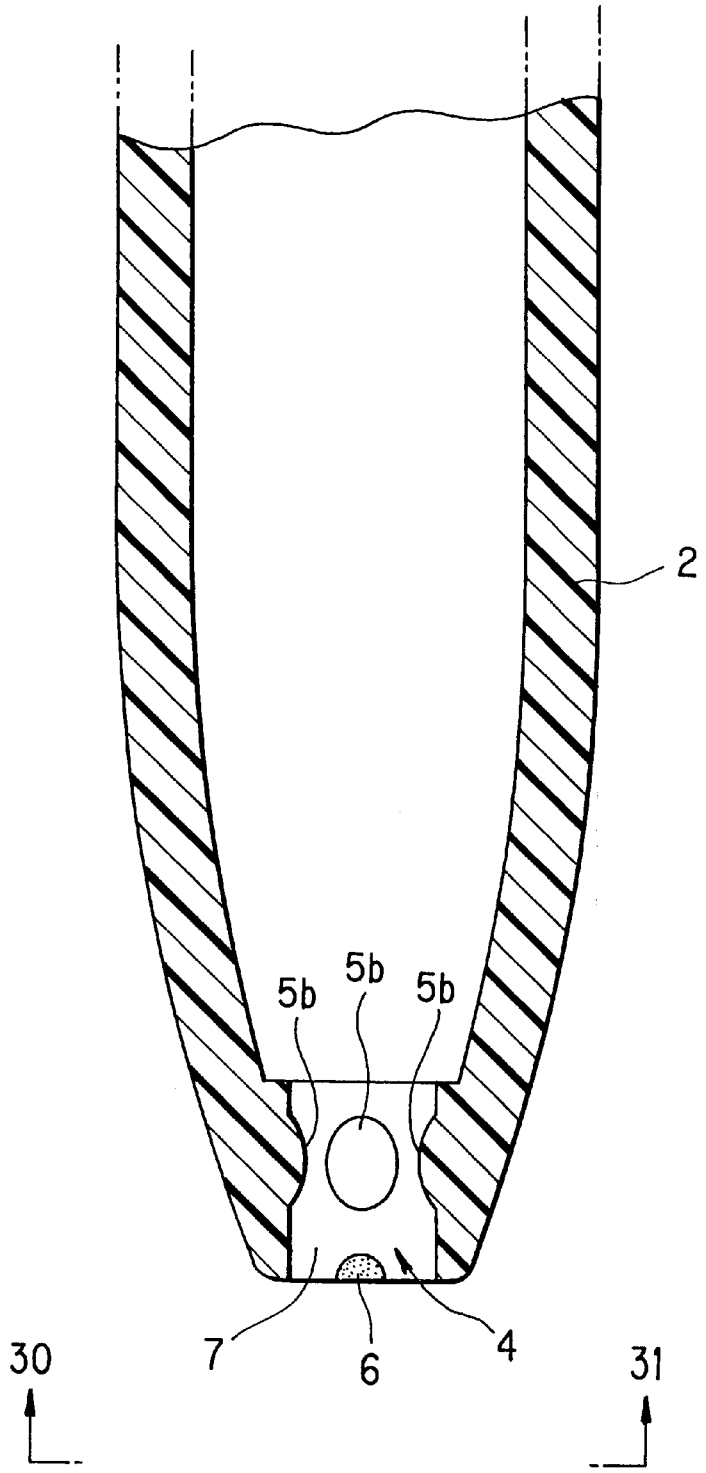
FIG. 9 is an enlarged sectional view of the distal end portion of the barrel cylinder.
Figure 10:
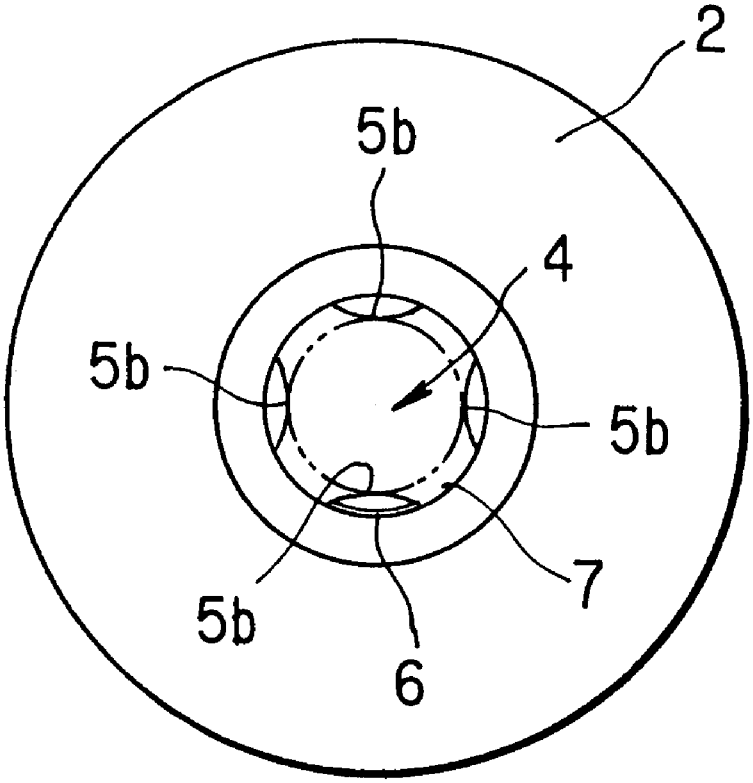
FIG. 10 is a view seen along the line 30-31 of FIG. 9.

Although the surfaces of the writing element support projections 5*b* form flat surfaces in this embodiment, they can form curved surfaces, as shown in FIGS. 9 and 10.

Although this embodiment relates to a barrel cylinder for a clicking-type ball point pen, the present invention is not limited to this, and the type of writing instrument is arbitrary.

A barrel cylinder for a writing instrument according to the present invention has the structure as described above. Since the gate mark 6 appears on the portion of the inner surface portion of the enlarged port portion 7 of the distal end port 4 of the barrel cylinder, the gate mark 6 is not noticeable so that the outer appearance is improved. Since the distal end port 4 of the barrel cylinder is divided into the portion where the writing element support projections 5*b* are formed and the enlarged port portion 7, and the gate mark 6 appears at the enlarged port portion 7, the precision of the portions where the writing element support projections 5*b* are formed is not adversely affected by the gate mark 6 and can be improved easily. Since the inner diameter of the enlarged port portion 7 is set to be larger than the inscribed diameter of each portion where the writing element support projection 5*b* is formed and a step is formed on the inner surface of the enlarged port portion 7, even if the gate mark 6 might appear on the enlarged port portion 7 projects slightly, the projecting amount of the gate mark 6 can be absorbed by the step on the inner surface of the enlarged port portion 7, and the gate mark 6 will not at all adversely affect the writing element 3 supported by the writing element support projections 5*b*. Accordingly, in spite that the gate mark 6 appears, the writing element 3 is smoothly supported by the writing element support projections 5*b*. If the writing element 3 is extended/retracted, it is guided smoothly, and does not cause an operational error.

What is claimed is:

1. A barrel cylinder for a writing instrument, the barrel cylinder adapted to movably support an elongated writing element such that a writing tip of the writing element is extendable from within the barrel cylinder, the barrel cylinder comprising:

a front barrel cylinder body having:

a proximal end and a distal end defining a longitudinal axis;

a deep portion of said distal end defining a writing element support hole along the longitudinal axis, the writing element support hole having a first diameter slightly larger than a diameter of the writing element; and an inlet portion of said distal end defining an enlarged port opening outwardly along the longitudinal axis, the port aligned and in communication with the writing element support hole, the port having a second diameter larger than the first diameter;

wherein a difference between the first diameter and the second diameter defines a clearance between the writing element and an inner surface of said enlarged port, and wherein a gate mark is formed on said inner surface.

2. A barrel cylinder for a writing instrument according to claim 1 wherein the clearance is sufficient to accommodate a plurality of gate marks on said inner surface.

3. A barrel cylinder for a writing instrument, the barrel cylinder adapted to movably support an elongated writing element such that a writing tip of the writing element is extendable from within the barrel cylinder, the barrel cylinder comprising:

a front barrel cylinder body having:

a proximal end and a distal end defining a longitudinal axis;

a deep portion of said distal end defining a writing element support hole along the longitudinal axis, an inner surface of the writing element support hole having a plurality of inwardly directed writing element support projections circumferentially arranged to define a first diameter slightly larger than a diameter of the writing element; and an inlet portion of said distal end defining an enlarged port opening outwardly along the longitudinal axis, the port aligned and in communication with the writing element support hole, the port having a second diameter larger than the first diameter;

wherein a difference between the first diameter and the second diameter defines a clearance between the writing element and an inner surface of said enlarged port, and wherein a gate mark is formed on said inner surface.

4. A barrel cylinder for a writing instrument according to claim 3 wherein the clearance is sufficient to accommodate a plurality of gate marks on said inner surface.

5. A barrel cylinder for a writing instrument according to claim 3 wherein the writing element support projections are formed at not less than three locations.

6. A barrel cylinder for a writing instrument according to claim 3 wherein a surface of each of said writing element support projections is a curved surface.

* * * * *